US005827988A

United States Patent [19]

Wachi

[11] Patent Number: 5,827,988

[45] Date of Patent: Oct. 27, 1998

[54] ELECTRONIC MUSICAL INSTRUMENT WITH AN INSTRUCTION DEVICE FOR PERFORMANCE PRACTICE

[75] Inventor: Masatada Wachi, Hamamatsu, Japan

[73] Assignee: Yamaha Corporation, Japan

[21] Appl. No.: 450,415

[22] Filed: May 25, 1995

[30] Foreign Application Priority Data

May 26, 1994 [JP] Japan ..... 6-113070

[51] Int. Cl.[6] ..... A63H 5/00; G04B 13/00; G10H 7/00

[52] U.S. Cl. ..... 84/609; 84/478; 84/746

[58] Field of Search ..... 84/609, 614, 634, 84/649, 746, 464 A, 464 R, 477 R, 478

[56] References Cited

U.S. PATENT DOCUMENTS

| | | | |
|---|---|---|---|
| 4,703,681 | 11/1987 | Okamoto | 84/484 X |
| 5,107,743 | 4/1992 | Decker | 84/478 |
| 5,225,618 | 7/1993 | Wadhams | 84/634 X |
| 5,231,239 | 7/1993 | Tsumura et al. | 84/609 |
| 5,400,687 | 3/1995 | Ishii | 84/477 R |
| 5,410,097 | 4/1995 | Kato et al. | 84/477 R X |
| 5,544,562 | 8/1996 | Jeon | 84/478 X |
| 5,557,055 | 9/1996 | Breitweiser, Jr. | 84/478 |

*Primary Examiner*—William M. Shoop, Jr.
*Assistant Examiner*—Jeffrey W. Donels
*Attorney, Agent, or Firm*—Graham & James LLP

[57] ABSTRACT

An electronic musical instrument having a plurality of performance operation elements such as a plurality of keys on a keyboard, wherein a series of memorized performance data indicative of the performance operation elements are successively read out in accordance with lapse of a time to instruct a performance operation element to be operated by a player on a basis of the read out performance data, and wherein the readout of the performance data is repeatedly designated to return a readout position of the performance data in a predetermined section to a previously read out position of the performance data.

8 Claims, 11 Drawing Sheets

LIGHT
BLINK
10
11
12
KEY SWITCH CIRCUIT
13
LIGHT-EMITTING ELEMENT CONTROL CIRCUIT
20
FOOT OPERATION ELEMENT
21
FOOT SWITCH
30
OPERATION PANEL
31
OPERATION SWITCH CIRCUIT
F D
41
DISC DRIVER
42
INTERFACE
40
PERFORMANCE INFORMATION MEMORY (RAM)
70
60
CPU
63
TIMER
62
PROGRAM MEMORY (ROM)
61
WORKING MEMORY (RAM)
50
MUSICAL TONE SIGNAL FORMING CIRCUIT
51
SOUND SYSTEM

FIG. 2(A)

PERFORMANCE INFORMATION
TRACK 0, 1

| |
|---|
| BLINK DATA |
| DURATION DATA |
| LIGHT DATA |
| KEY DATA |
| BLINK DATA |
| DURATION DATA |
| LIGHT DATA |
| KEY DATA |
| BLINK DATA |
| DURATION DATA |
| |
| PHRASE CODE |
| |
| END CODE |

FIG. 2(B)

BLINK DATA

| |
|---|
| BLINK CODE |
| KEY CODE |

FIG. 2(C)

DURATION DATA

| |
|---|
| DURATION CODE |
| DURATION TIME |

FIG. 2(D)

LIGHT DATA

| |
|---|
| LIGHT CODE |
| KEY CODE |

FIG. 2(E)

KEY DATA

| |
|---|
| KEY-ON CODE |
| KEY CODE |
| GATE TIME |

REPRODUCTION
500
TR ← 0
502
TM (TR) ≦ 0
504
NO
YES
READ OUT
DATA POINTED BY POINTER OF
TRACK TR
506
TM (TR) ←
TM (TR) - 1
508
END CODE ?
510
YES
NO
DURATION DATA
512
YES
NO
DATA PROCESSING
514
TM (TR) ←
DURATION TIME
516
SET POINTER
TO NEXT DATA
518
TR ← TR + 1
520
TR = 9
522
NO
YES
RETURN
524

ELECTRONIC MUSICAL INSTRUMENT WITH AN INSTRUCTION DEVICE FOR PERFORMANCE PRACTICE

BACKGROUND OF THE INVENTION

1. Field of the Invention

The present invention relates to an electronic musical instrument provided with a plurality of performance operation elements such as keys on a keyboard, more particularly to an electronic musical instrument of the type wherein a series of preliminarily memorized performance data indicative of performance operation elements are successively read out in accordance with lapse of a time so that performance operation elements to be operated are successively instructed on a basis of the read out performance data.

2. Description of the Prior Art

There has been proposed an electronic musical instrument of the keyboard type wherein a series of performance data memorized in a memory are read out in accordance with progression of a musical tune so that a plurality of light-emitting elements arranged in correspondence with a plurality of keys on the keyboard are lighted on a basis of the read out performance data, and wherein when a key instructed by the lighted light-emitting element is depressed by a player, a performance data indicative of the following tone pitch is read out so that a key to be subsequently operated is successively instructed on a basis of the read out performance data.

In such a conventional electronic musical instrument as described above, however, the memorized performance data are automatically read out if a key to be operated is correctly depressed by the player after it has been depressed in error. It is, therefore, unable to return the readout position of the performance data. In usual performance practice of a musical tune, the player intends to repeat performance practice of a portion of the musical tune he failed in his performance or a difficult portion of the musical tune. In such an instance, it is required to restart reproduction of the performance data from the first part of the musical tune.

SUMMARY OF THE INVENTION

It is, therefore, a primary object of the present invention to provide an improved electronic musical instrument wherein a readout position of performance data can be freely returned by the player's intention to repeat performance practice of a desired part of the performance data.

According to an aspect of the present invention, the object is accomplished by providing an electronic musical instrument which comprises a plurality of performance operation elements; memory means for memorizing a series of performance data indicative of the performance operation elements; readout means for successively reading out the memorized performance data from the memory means in accordance with lapse of a time; instruction means for instructing a performance operation element to be operated by a player on a basis of the read out performance data; designation means for repeatedly designating the readout of the performance data; and means for returning the readout position of the performance data in a predetermined section in response to operation of said designation means.

According to an aspect of the present invention, the performance operation elements are in the form of a plurality of manually operated elements such as a plurality of keys on a keyboard, and the designation means comprises an operation element such as a foot pedal to be operated by the player's foot.

According to another aspect of the present invention, the predetermined section in which the readout position of the performance data is returned is defined to correspond with a phrase or a measure of a musical tune.

According to a further aspect of the present invention, the electronic musical Instrument further comprises count means for counting the number of operation of the designation means, wherein the means for returning the readout position of the performance data is arranged to return the readout position of the performance data in a section determined in accordance with the number of operation counted by the count means.

BRIEF DESCRIPTION OF THE DRAWINGS

Other objects, features and advantages of the present invention will be more readily appreciated from the following detailed description of a preferred embodiment thereof when taken together with the accompanying drawings, in which:

FIG. 2(A) is a data format of performance information memorized in a performance information memory shown in FIG. 1;

FIG. 2(B) is a data format or a blink data in the performance information;

FIG. 2(C) is a data format of a duration data in the performance information;

FIG. 2(D) is a data format of a light data in the performance information;

FIG. 2(E) is a data format of a key data in the performance information;

DESCRIPTION OF THE PREFERRED EMBODIMENT

Figure 1:
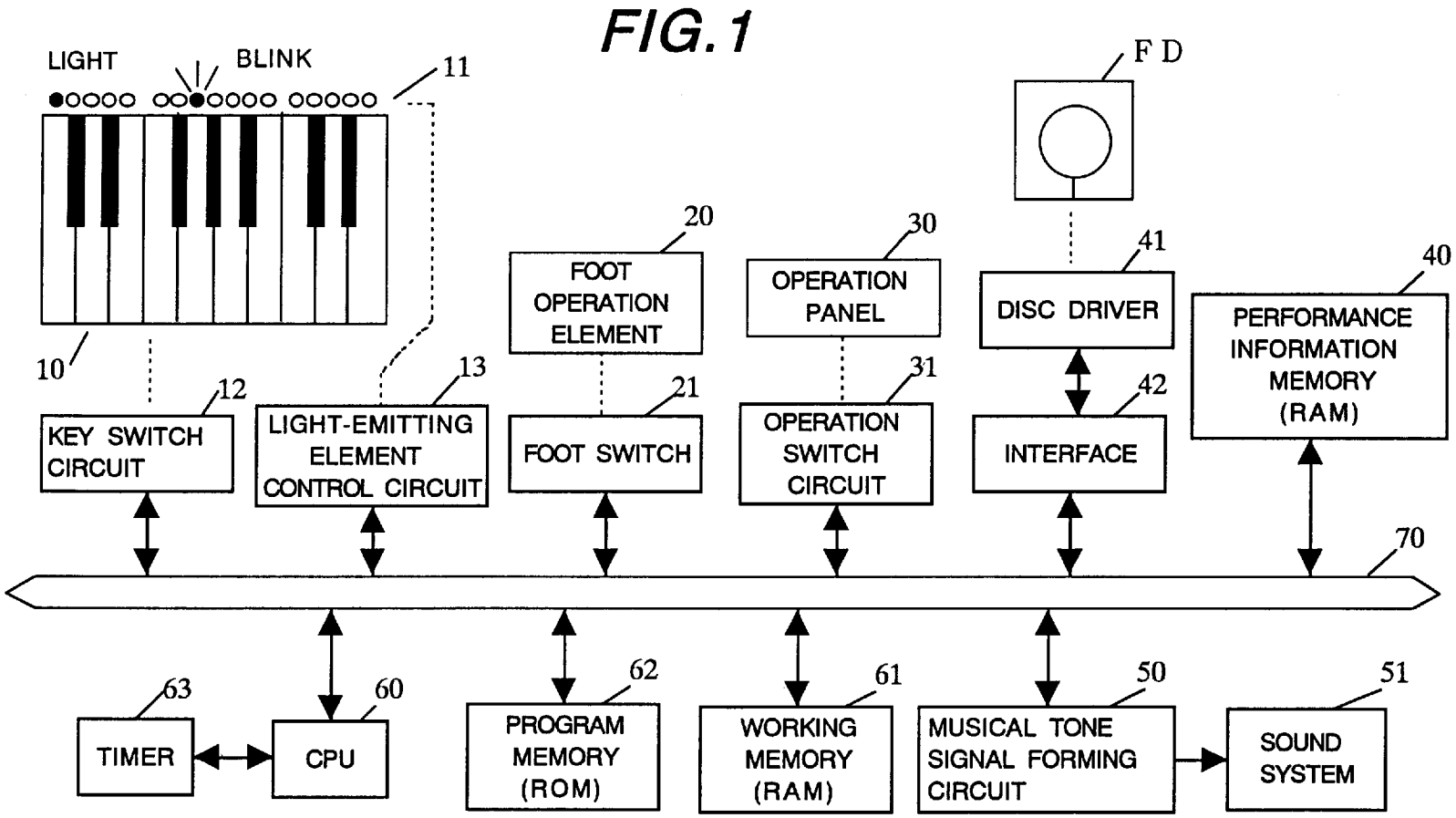
FIG. 1 is a block diagram of an electronic musical instrument in accordance with the present invention.

Referring now to the drawings, FIG. 1 illustrates a block diagram of an electronic musical instrument according to the present invention, which includes a keyboard 10, a foot operation element 20, an operation panel 30, a performance information memory 40, a musical tone signal forming circuit 50 and a central processing unit or CPU 60 of a microcomputer.

The keyboard 10 is provided with a plurality of performance operation elements in the form of a plurality of keys and a plurality of light-emitting elements 11 arranged in correspondence with the respective keys. Depression or release of each key on the keyboard is detected by a key switch provided in a key switch circuit 12 in correspondence with the respective keys on the keyboard 10. The light-emitting elements 11 are turned on and off under control of a light-emitting element control circuit 13, respectively. These key switch circuit 12 and light-emitting element control circuit 13 are connected to a bus line 70.

The foot operation element 20 is arranged to be operated by the player's foot for turning on a foot switch 21 of the normally open type. The operation panel 30 is provided with a plurality of operation elements for designating various operation modes of the electronic musical Instrument. Operation of the operation elements is detected by an operation element switch provided in an operation element switch circuit 31 in correspondence with the respective operation elements. The foot switch 21 and operation element switch circuit 31 are also connected to the bus line 70.

The performance information memory 40 is in the form of a random access memory or RAM which has a plurality of memory regions for respectively memorizing performance information of a plurality of tracks (in this embodiment, performance information of tracks "0"–"8") corresponding with a plurality of performance parts (in this embodiment, nine (9) parts) of a musical tune. Each performance information of the tracks "0" and "1" is comprised of a series of performance data such as a blink data, a duration data, a light data, a key data, a blink data, a phrase code and an end code as shown in FIG. 2(A).

Figure 3:
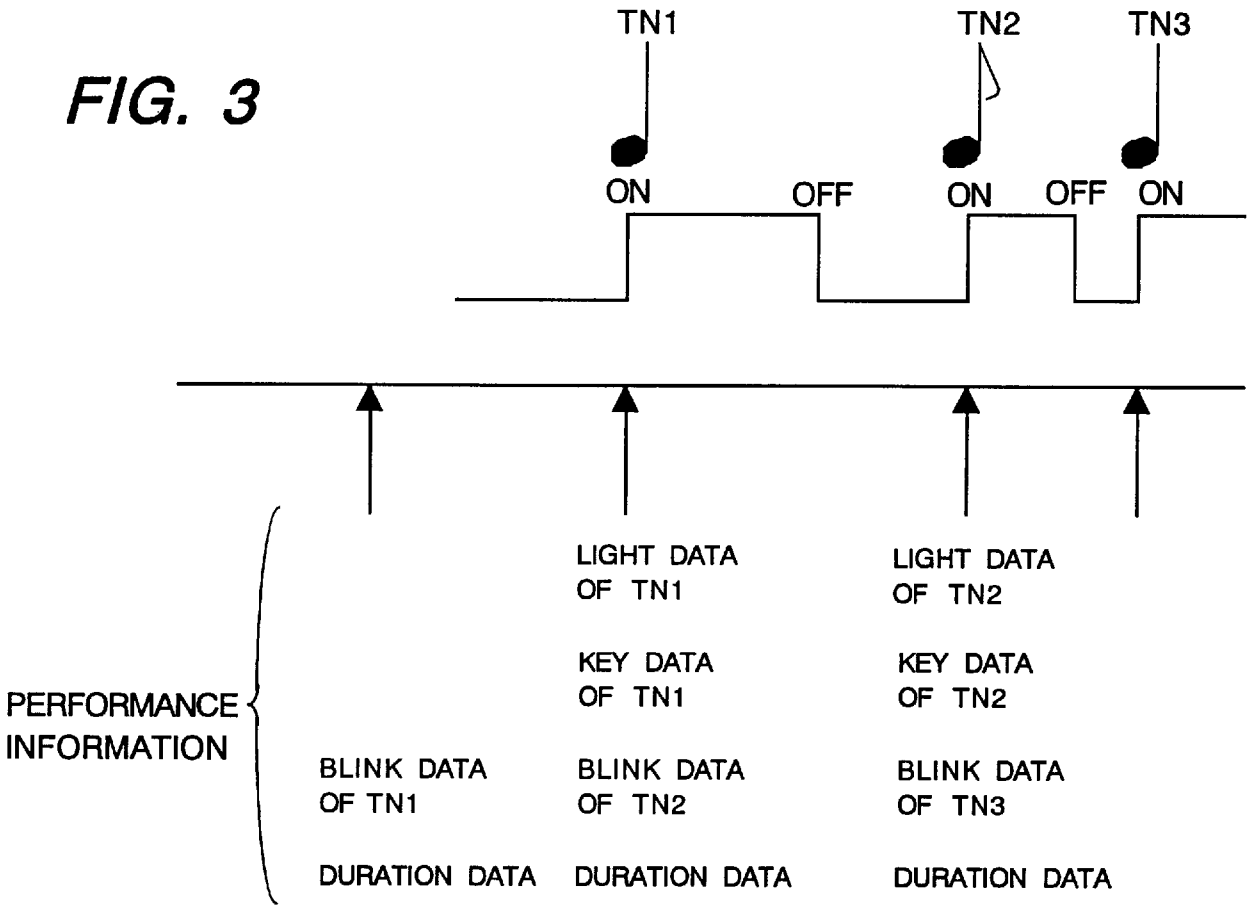
FIG. 3 is a time chart showing the performance information in relation to a series of notes.

As shown in FIG. 2(B), the blink data is comprised of discrimination codes in the form of a blink code and a key code indicative of a key to be subsequently depressed. As shown in FIG. 3, the blink data is memorized in a time position prior in one note to a tone to be performed. As shown in FIG. 2(C), the duration data is comprised of discrimination codes in the form of a duration code and a duration time indicative of a time interval between respective notes (a period from a sound start time of respective notes to a sound start time of the following note) As shown in FIG. 2(D), the light data is comprised of discrimination codes in the form of a light code and a key code indicative of a key to be depressed. As shown in FIG. 2(E), the key data is comprised of discrimination codes in the form of a key-on code, a key code indicative of a tone pitch of a musical tune to be sounded and a gate time indicative of a key-on time of respective notes. As shown in FIG. 3, these duration data, light data and key data are memorized in a time position of a note to be performed. Provided that, the first duration time is set as a predetermined note length (for instance, a quarter note), and the first blink data is memorized in a time position prior in the predetermined note length to actual start of performance of the musical tune. The phrase code is memorized in each end of the phrases of the musical tune. The end code is memorized in the end of the musical tune. Each performance information of the tracks "2"–"8" is the same, except for the blink data and light data of the performance information.

Connected to the bus line 70 is the performance information memory 40 which is supplied with each performance information of the tracks "0"–"8" memorized in an external memory medium in the form of a flexible disc FD through a disc driver 41, an interface 42 and the bus line 70. In addition, each performance information of the tracks "0"–"8" is memorized in the flexible disc FD as performance information of a piece of musical tune.

The musical tone signal forming circuit 50 includes a plurality of musical tone signal forming channels (in this embodiment, sixteen (16) channels) which are arranged to produce a musical tone signal on a basis of a control data such as the key code, key-on data, key-off data and tone color control data supplied thereto through the bus line 70. The musical tone signal forming circuit 50 is connected to a sound system 51 composed of an amplifier and a speaker.

The CPU 60 cooperates with a working memory (RAM) 61 connected to the bus line 70 to execute control programs or the electronic musical instrument shown by flow charts in FIGS. 4–11 and memorized in a program memory (ROM) 62. The CPU 60 is connected to a timer 63 which produces an interruption signal at each lapse of a predetermined time (for instance, a time defined by a ninety sixth (96) note length). When applied with the interruption signal, the CPU 60 initiates execution of an interruption program shown by the flow chart in FIG. 7.

Hereinafter, operation of the electronic musical instrument will be described with reference to the flow charts shown in FIGS. 4 to 11. Assuming that a power source switch (not shown) of the electronic musical instrument has been closed, the CPU 60 initiates execution of a main program at step 100 shown in FIG. 4. After initializing various kinds of variables at step 102, the CPU 60 repeats execution of processing at step 104 to 136. At step 136 of FIG. 5, the CPU 60 produces a control data for a tone color, tone volume, a musical effect, etc. In response to operation of the operation elements related to the tone color, tone volume, musical effect, etc. and applies the control data to the musical tone signal forming circuit 50. When applied with the control data, the musical tone signal forming circuit 50 is conditioned to control the tone color, tone volume, musical effect, etc. on a basis of the control data, as will be described later.

(A) Keyboard Performance

Figure 4:
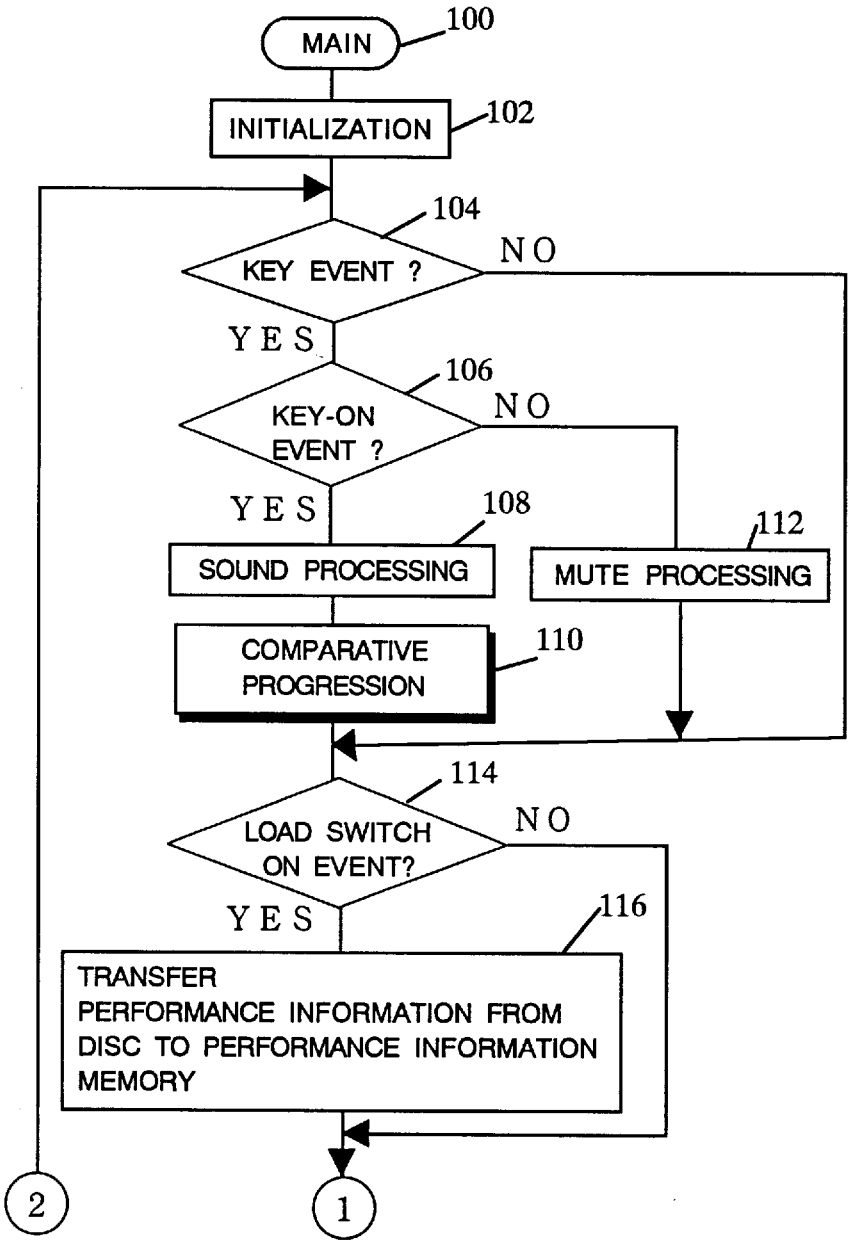
FIG. 4 illustrates a first part of a flow chart of a main program memorized in a program memory shown in FIG. 1.

Assuming that the keyboard 10 has been performed by a player to produce a musical tone signal, the CPU 60 determines a "Yes" answer at step 104 shown in FIG. 4 and causes the program to proceed to step 106 to 112. At step 106, the CPU 60 determines whether the key-event is a key-on event or not. If the answer at step 106 is "Yes", the CPU 60 executes sound processing at step 108. During sound processing at step 108, the CPU 60 assigns a depressed key to an available channel in the musical tone signal forming circuit 50 and stores a discrimination data representing a key code indicative of the name of the depressed key and the assigned channel of the key performance data in an assignment channel list in the working memory 61. In this instance, the CPU 60 changes a key on-off data of the assigned channel to a key-on data. When applied with the key code, key-on data and the channel data indicative of the assigned channel under control of the CPU 60, the musical tone signal forming circuit 50 produces a musical tone signal of a tone pitch defined by the key code at the musical tone signal forming channel designated by the channel data and applies the musical tone signal to the sound system 51. Thus, a musical tone is sounded by the sound system 51 in response to key depression of the keyboard 10.

Figure 8:
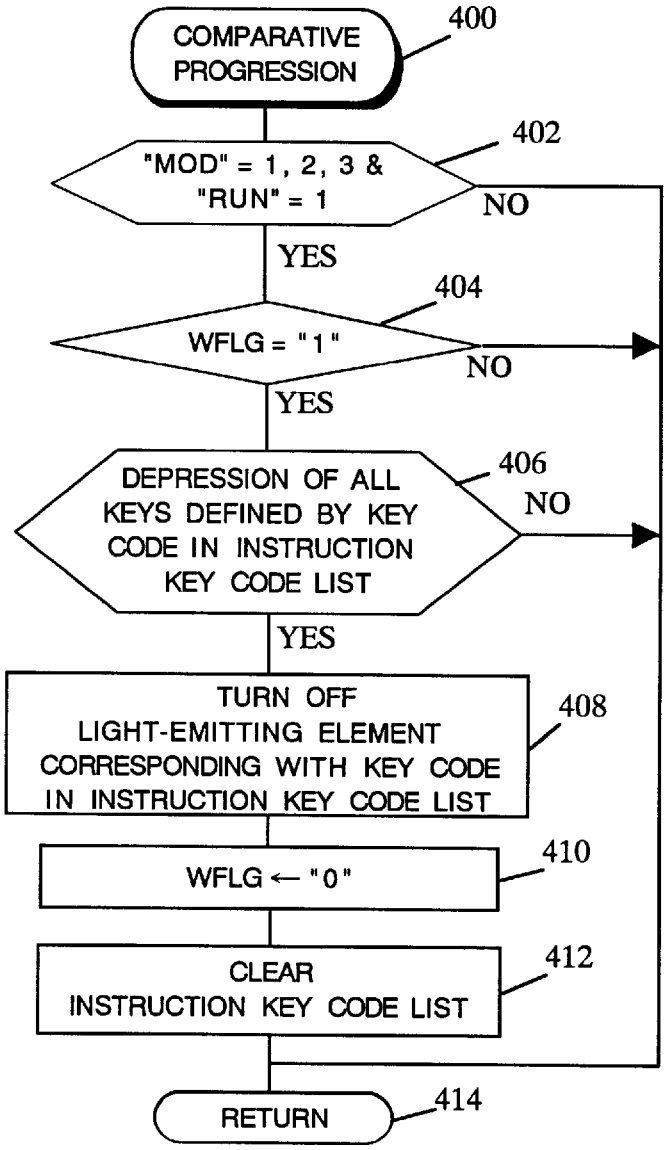
FIG. 8 is a flow chart of a comparative progression routine shown in FIG. 7.

After processing at step 108, the CPU 60 executes at step 110 a comparative progression routine shown in FIG. 8. At step 400 of FIG. 8, the CPU 60 initiates the execution of the comparative progression routine. Since at this initial stage a flag "RUN" indicative of automatic performance condition is set as "0", the CPU 60 determines a "No" answer at step 402 and causes the program to proceed to step 414 where the CPU 60 finishes the execution of the comparative progression routine. If the key event is a key-off event, the CPU 60 determines a "No" answer at step 106 shown in FIG. 4 and executes mute processing at step 112. During this mute processing, the CPU 60 searches a musical tone signal channel assigned with a released key from the assignment channel list and changes a key on-off data of the assignment channel to a key-off data. When applied with the channel data and the key-off data under control of the CPU 60, the musical tone signal forming circuit 50 halts production of a musical tone signal being formed at the musical tone signal forming channel designated by the channel data after attenuated the musical tone signal.

(B) Transfer of Performance Information

For transfer of performance information, the player sets a flexible disc FD memorized with performance information of a piece of musical tune into the disc driver 41 and turns on a load switch provided on the operation panel 20. In turn, the CPU 60 determines a "Yes" answer at step 114 shown in FIG. 4 and reads out at step 116 performance information of the piece of musical tune from the flexible disc FD in sequence to write the read out performance information into regions allotted to respective performance parts of the performance information memory 40 through the interface 42 and bus line 70. In case performance information of plural musical tunes is memorized in the flexible disc FD, a desired musical tune is designated by the player so that the disc driver 41 reads out performance information of the designated musical tune and transfers it to the performance information memory 40.

(C) Automatic Performance

For effecting automatic performance based on the performance information memorized in the performance information memory 40, the player operates a mode changeover element on the operation panel 20. In response to operation of the mode changeover element, the CPU 60 determines a "Yes" answer at step 118 shown in FIG. 5 and changes over mode data MOD in sequence. If the present mode data MOD is "0", the CPU 60 changes the mode data MOD to "1". If the mode data MOD is "1", the CPU 60 changes the mode data to "2". If the mode data MOD is "2", the CPU 60 changes the mode data to "3". If the mode data is "3", the CPU 60 changes the mode data to "0".

The mode data of "0" represents a normal reproduction mode for automatic reproduction of the performance information of tracks "0"–"8". The mode data of "1" represents a right hand guide mode for automatic reproduction of the performance information of tracks "0"–"8" and for utilizing the performance information of track "0" for instruction of the right hand's key depression. The mode data of "2" represents a left hand guide mode for automatic reproduction of the performance information of tracks "0", "2"–"8" and for utilizing the performance information of track "1" for instruction of the left hand's key depression. The mode data of "3" represents a both hand guide mode for automatic reproduction of the performance information of tracks "2"–"8" and for utilizing the performance information of tracks "0", "1" for instruction of the right and left hands' key depression.

When the player operates a start/stop operation element on the operation panel 20 after setting of the reproduction mode, the CPU 60 determines a "Yes" answer at step 122 and inverts at step 124 a flag RUN "1" indicative of the fact that automatic performance is being effected. The flag RUN is changed to "1" if it is "0" and to "0" if it is "1". If the flag RUN is set as "1" as a result of inversion, the CPU 60 determines a "Yes" answer at step 126 and executes at step 128 a start routine for automatic performance shown in FIG. 6. Thereafter, the CPU 60 executes an interruption program shown in FIG. 7 to reproduce the performance information based on the memorized mode data MOD as will be described later. If the flag RUN is set as "0" as a result of the inversion, the CPU 60 determines a "No" answer at step 126 and halts reproduction of the performance information at step 130.

Figure 6:
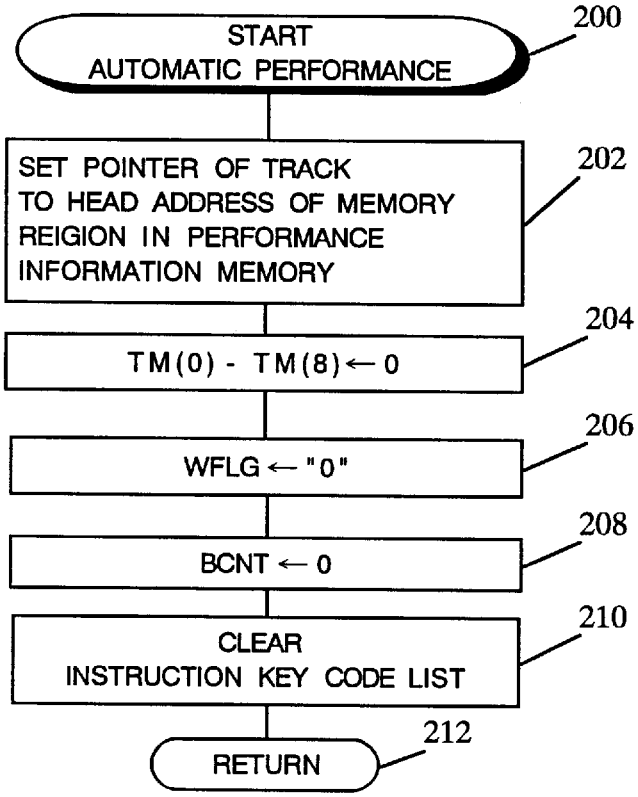
FIG. 6 is a flow chart of an automatic start routine shown in FIG. 5.

During execution of the start routine for automatic performance, the CPU 60 starts execution of the start routine at step 200 of FIG. 6 and sets at step 202 each pointer of all the tracks "0"–"8" to each head address of regions assigned to performance parts in the performance information memory 40. Subsequently, the CPU 60 initializes at step 204 duration time count values TM(0)–TM(8) for measurement of a time interval (a note length) of each note of the tracks. At the following step 206, the CPU 60 initializes a waiting flag WAIT for temporarily interrupting the progress of automatic performance until a key instructed by the performance information is correctly depressed. When the program proceeds to step 208, the CPU 60 initializes a count value BCNT for designating a return position in reproduction of the automatic performance and causes the program to proceed to step 210 where the CPU 60 clears an instruction key-code list stored in the working memory 61 for memorizing one or plural key-codes indicative of a key or plural keys to be depressed by the player on a basis of the performance information of tracks "0", "1". After processing at step 210, the CPU 60 finishes the execution of the start routine for automatic performance at step 212.

Hereinafter, each automatic performance based on the mode data will be described.

(C1) Normal reproduction mode:

When the mode data MOD is set as "0" for normal performance mode, the CPU 60 executes the interruption program of FIG. 7 in response to an interruption signal applied thereto from the timer 63 as follows. The CPU 60 starts execution of the interruption program at step 300 to determine at step 302 whether the flag RUN is "1" or not and to determine at step 304 whether the waiting flag WFLG is "1" or not. Since in this instance the flag RUN is being set as "1" while the waiting flag WFLG is being set as "0", the CPU 60 determines a "Yes" answer at step 302 and determines a "No" answer at step 304. Thus, the CPU 60 causes the program to proceed to step 306 for execution of a reproduction routine shown in FIG. 9.

Figure 9:
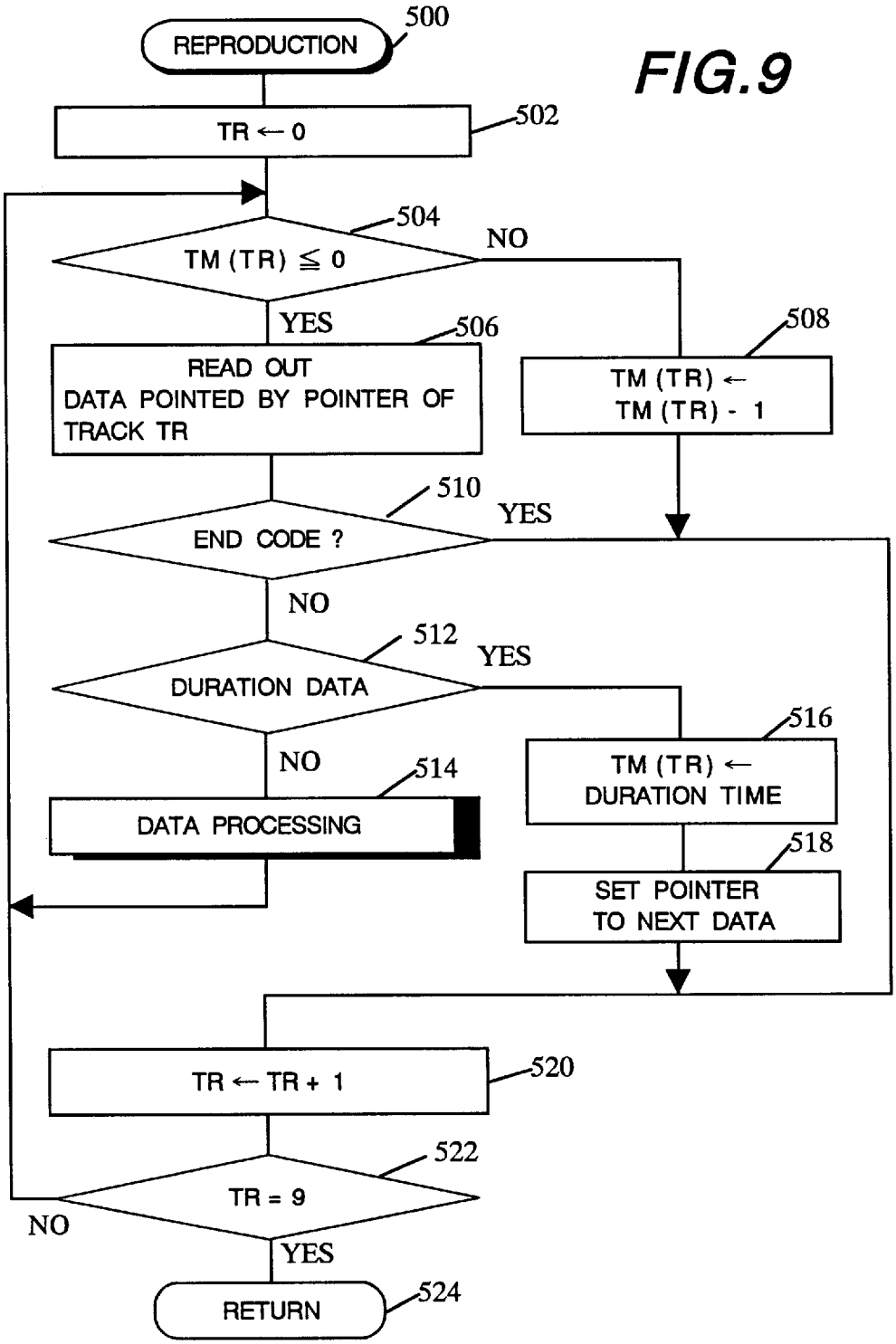
FIG. 9 is a flow chart of a reproduction routine shown in FIG. 7.

When started execution of the reproduction routine at step 500 shown in FIG. 9, the CPU 60 sets the track number TR as "0" at step 502. Thereafter, the CPU 60 determines at step 504 whether the duration time count value TM(TR) designated by the track number TR is less than or equal to "0" or not. Since in this instance the duration time count value TM(TR) is set as "0" during execution of the foregoing start routine for automatic performance, the CPU 60 determines a "Yes" answer at step 504 and reads out at step 506 a performance data designated by the reading pointer of the track number TR in the automatic performance memory 40. Subsequently, the CPU 60 determines at step 510 whether the read out performance data is an end code or not and determines at step 512 whether the read out performance data is the duration data or not. Since in this instance the first performance data of track "0" is a blink data shown in FIG. 2(A), the CPU 60 determines a "No" answer respectively at step 510 and 512 and causes the program to proceed to step 514 for execution of a data processing routine shown in FIGS. 10 and 11.

Figure 10:
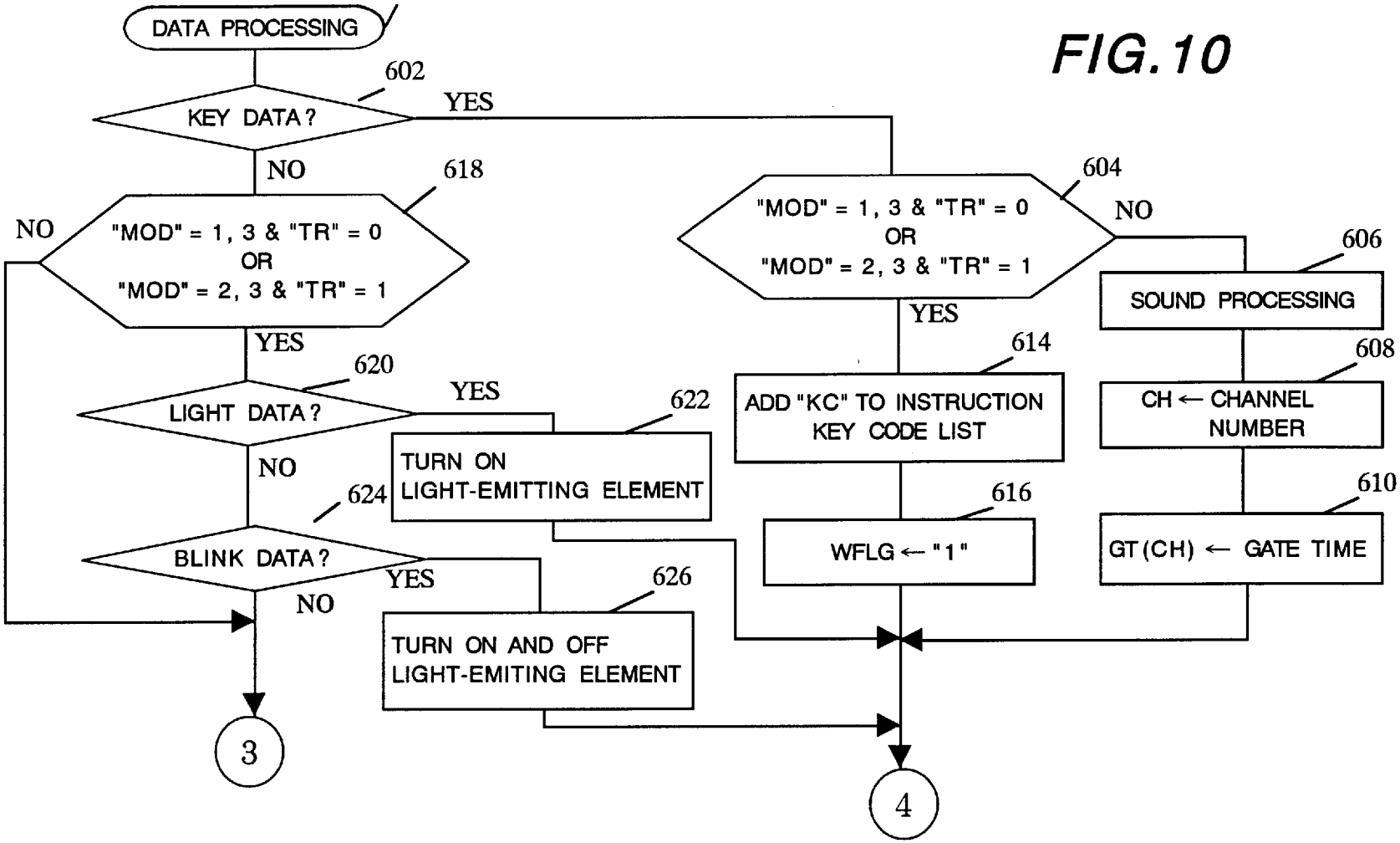
FIG. 10 illustrates a first part of a data processing routine shown in FIG. 9.

When started execution of the data processing routine at step 600 shown in FIG. 10, the CPU 60 determines at step 602 whether the read out performance data is a key data or not. Since in this instance the read out performance data is the blink data, the CPU 60 determines a "No" answer at step 602 and causes the program to proceed to step 618. At step 618, the CPU 6 determines whether or not the mode data MOD is "1", "2" or "3" and determines whether the track number TR is "0" or "1". Since in this instance the mode data MOD is "0", the CPU 60 determines a "No" answer at step 618 and causes the program Lo proceed to step 628 shown in FIG. 11. At step 628, the CPU 60 determines whether the read out performance data is a phrase code or not. Since the performance data is the blink data, the CPU 60 determines a "No" answer at step 628 and causes the reading pointer at step 632 to proceed to a memory address of the following performance data. Thus, the CPU 60 finishes the execution of the data processing routine at step 642 and causes the program to proceed to step 504 of the reproduction routine shown in FIG. 9.

During execution of the reproduction routine, the CPU 60 determines a "Yes" answer at step 504 as in the previous processing and reads out the following performance data at step 506. Since the following performance data is a duration data as shown in FIG. 2(A), the CPU 60 determines a "Yes" answer at step 512 after determined a "No" answer at step 510 and sets at step 516 a duration time in the read out duration data as a duration time count value TM(TR) designated by the track number TR (=0). Subsequently, the CPU 60 sets at step 518 the reading pointer to a memory address value of the following performance data.

When the program proceeds to step 520, the CPU 60 adds "1" to the track number TR and causes the program to proceed to step 522 where the CPU 60 determines whether the track number added with "1" is "9" or not. Since in this instance the track number TR becomes "1", the CPU 60 determines a "No" answer at step 522 and returns the program to step 504. As the performance information of the track "1" is formed by the first blink data as a duration data, the CPU 60 sets a duration time of the duration data as the duration time count value TM(TR) by processing at step 504, 506, 510–518 and sets the reading pointer to a memory address value of the following performance data.

Thereafter, the CPU 60 changes the track number TR to "2" at step 520 and returns the program to step 504. Since the performance information of the track "2" becomes a first duration data, the CPU 60 sets a duration time of the duration data as the duration time count value TM(TR) by processing at step 504, 506, 510–518 and sets the reading pointer to a memory address value of the following performance data. Subsequently, the CPU 60 repeats the foregoing processing until the track number TR becomes "9". Since the performance information of the tracks "3" to "8" is provided as a first duration data as in the performance information of the track "2", the CPU 60 sets a read out duration time as the duration time count value TM related to the tracks "3" to "8" and sets each reading pointer of the tracks "3" to "8" to a memory address value of the following performance data. The first duration data of the respective tracks "0" to "8" is set as the same value.

When the track number TR becomes "9", the CPU 60 determines a "Yes" answer at step 522 and finishes the execution of the reproduction routine at step 524. Thereafter, the CPU 60 executes the comparative progression routine at step 308 shown in FIG. 7. The execution of the comparative progression routine is initiated at step 400 of FIG. 8 but the mode data MOD is set as "0". Thus, the CPU 60 determines a "No" answer at step 402 and finishes the execution of the comparative progression routine at step 414.

Figure 7:
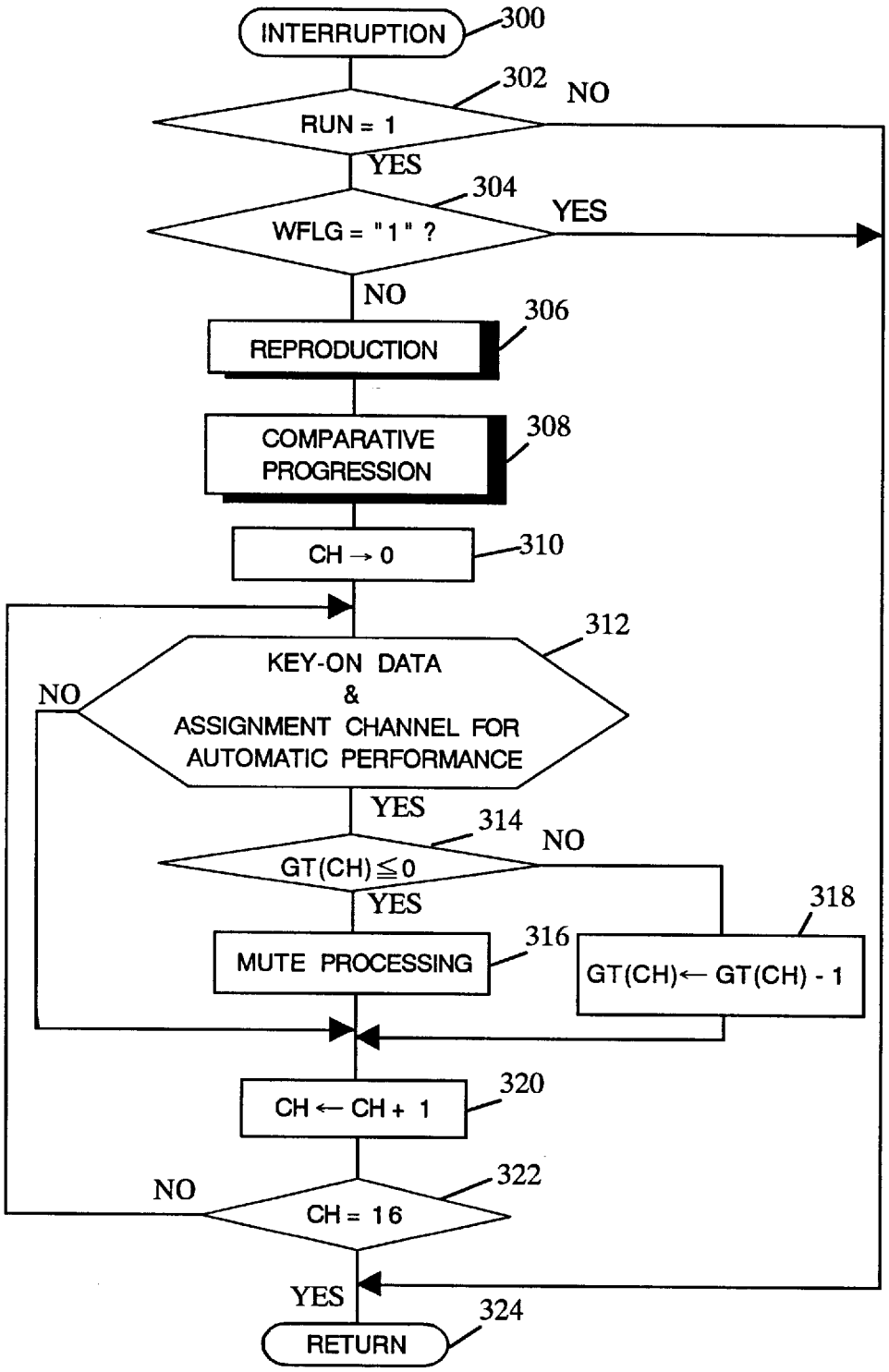
FIG. 7 is a flow chart of an interruption program memorized in the program memory shown in FIG. 1.

After processing at step 308 shown in FIG. 7, the CPU 60 initializes at step 310 the channel number CH to "0" and determines at step 312 whether the channel number CH represents an assignment channel of the automatic performance data or not. The determination of the channel number CH is made in such a manner as to determine whether a key on-off data designated by the channel number CH in the assignment channel list represents a key-on or not and to determine whether or not the key on-off data represents a channel assigned to the automatic performance data. Since in this instance the automatic performance data is not yet assigned to a musical tone signal forming channel, the key on-off data of all the channels represents a key-off, and the discrimination data does not represent the assignment channel of the automatic performance data. Thus, the CPU 60 determines a "No" answer at step 312 and causes the program to proceed to step 320. At step 320, the CPU 60 adds "1" to the channel number CH and causes the program to proceed to step 322 where the CPU 60 determines whether the channel number CH is "16" or not. If the answer at step 322 is "No", the program returns to step 312 where the CPU 60 determines a "No" answer until the channel number CH becomes "16". When the channel number CH becomes "16", the CPU 60 determines a "Yes" answer at step 322 and finishes the execution of the interruption program at step 324.

Even when the interruption program is being executed, the CPU 60 determines a "Yes" answer at step 302 and a "No" answer at step 304. Thereafter, the CPU 60 executes at step 306 the reproduction routine shown in FIG. 9. In this instance, the duration time count values TM(0)–(8) each are set as a predetermined large value in the same manner as described above. Thus, the CPU 60 determines a "No" answer at step 504 of FIG. 9 with respect to all the track numbers TR ("0"–"8") and causes the program to proceed to step 508. At step 508, the CPU 60 subtracts "1" from the duration time count value TM(TR) designated by the track number TR and causes the program to proceed to step 520. Since processing at step 504, 508 is executed with respect to all the track numbers TM(0)–TM(8) in dependence upon processing at step 502, 520, 522, all the duration time count values TM(0)–TM(8) each are subtracted by "1" at each execution of the interruption program. When the track number TR becomes "9", the CPU 60 determines a "Yes" answer at step 522 and finishes the execution of the reproduction routine. Thereafter, the CPU 60 executes processing of the comparative progression routine at step 310 of FIG. 7 and executes processing at step 310 to 322 as described above.

When the duration time count values TM(0)–TM(8) each become "0" at the same time, the CPU 60 determines a "Yes" answer at step 504 of FIG. 9 with respect to all the tracks "0"–"8". Thus, the performance data of all the tracks "0"–"8" are successively read out by execution of the reproduction routine until the following duration data is read out. With respect to the track "0", the CPU 60 reads out a light data by processing at step 506, (see FIG. 2(A)) Thus, the CPU 60 determines a "No" answer respectively at step 510 and 512 shown in FIG. 9 and determines a "No" answer at step 602 of the data processing routine shown in FIG. 10. Since in this instance the mode data MOD is "0", the CPU 60 determines a "No" answer at step 618 of the data processing routine and determines a "No" answer respectively at step 628 and 630 shown in FIG. 11. In turn, the CPU 60 sets at step 632 the reading pointer to a memory address value of the following performance data and reads out a key data by further processing at step 506 shown in FIG. 9. Thus, the CPU 60 determines a "Yes" answer at step 602 of the data processing routine after determined a "No" answer. respectively at step 510 and 512 and causes the program to proceed to step 604.

At step 604 of the data processing routine, the CPU 60 determines a "No" answer and causes the program to proceed to step 606 for execution of sound processing. At step 606, the CPU 60 assigns the read out key code to an available channel in the musical tone signal forming circuit 50 and memorizes a discrimination data indicative of the key code and the assigned channel for automatic performance in the assignment channel list in the working memory 81. At this time, the CPU 60 sets a key on-off data of the corresponding assignment channel in the list as a key-on data and applies the key code and key-on data to the musical tone signal forming circuit 50 together with the channel data indicative of the assigned channel. Thus, the musical tone signal forming circuit 50 produces a musical tone signal of a tone pitch defined by the key code at a musical tone signal forming channel designated by the channel data and applies the musical tone signal to the sound system 51. After processing at step 606. the CPU 60 sets a value indicative of the assigned channel as the channel number CH at step 608. At the following step 610, the CPU 60 sets a gate time in the read out key data as a gate time count value GT(CH) designated by the channel number CH and causes the program to proceed to step 632 shown in FIG. 11. At step 632, the CPU 60 sets the reading pointer to a memory address value of the following performance data.

Even when a blink data is read out by processing at step 506 shown in FIG. 9, processing of the blink data is not substantially effected as in processing of the light data. Accordingly, the CPU 60 sets at step 632 the reading pointer to a memory address value of the following performance data. Thereafter, the CPU 60 reads out a duration data by processing at step 506 and determines a "Yes" answer at step 512 after determined a "No" answer at step 510. When the program proceeds to step 516 after processing at step 512, the CPU 60 sets a duration time in the read out duration data as a duration time count value TM(TR) designated by the track number TR(=1). At the following step 518, the CPU 60 sets the reading pointer to a memory address value of the following performance data.

After processing at step 518, the CPU 60 changes the track number TR to "1" at step 520. In this instance, the performance information of track "1" is provided in the same kind as that of track "0". In turn, the CPU 60 assigns the read out key code to an available channel of the musical tone signal forming circuit 50 and memorizes a discrimination data indicative of the key code and the assigned channel for the automatic performance data in the assignment channel list in the working memory 61. Subsequently, the CPU 60 sets a key on-off data of the corresponding assignment channel in the list as a key-on data and applies the key code and key-on data to the musical tone signal forming circuit 50 together with the channel data indicative of the assigned channel. Thus, the musical tone signal forming circuit 50 produces a musical tone signal of a tone pitch defined by the key code at a musical tone signal forming channel designated by the channel data and applies the musical tone signal to the sound system 51. Thereafter, the CPU 60 sets a value indicative of the assigned channel as a channel number CH and sets a gate time in the read out key data as a gate time count value GT(CH) designated by the channel number CH. At the following step, the CPU 60 sets the reading pointer of track "1" to a memory address value of the following performance data. Subsequently, the CPU 60 sets a duration time in the read out duration data as a duration time count value TM(1) and causes the reading pointer to a memory position of the following performance data for reading out the performance data of track "2".

When the performance data of track "2" is addressed by the reading pointer, a key data shown in FIG. 2(A) is read out by processing at step 506. Accordingly, the CPU 60 executes processing at step 606 shown in FIG. 10 to assign the read out key code to an available channel of the musical tone signal forming circuit 50, to memorize the key code and a discrimination data indicative of the assigned channel for the automatic performance in the channel list and to set a key on-off data of the assigned channel as a key-on data. Thereafter, the CPU 60 causes the musical tone signal forming circuit 50 to produce a musical tone signal of a tone pitch defined by the key code at the assigned channel and sets a gate time in the key code as a gate time count value GT(CH) designated by a channel number CH indicative of the assigned channel. Subsequently, the CPU 60 causes the reading pointer at step 632 to proceed to a memory position of the following performance data and reads out at step 506 the following performance data of track "2" or a duration data. Thus, the CPU 60 executes processing at step 516 to set the read out duration time as a duration time count value TM(TR) designated by the assignment channel number CH and causes the reading pointer at step 518 to proceed to a memory position of the following performance data for reading out performance data of track "3".

Each performance information of the tracks "3"–"8" is in the form of the same data format as the performance information of track "2". Accordingly, the CPU 60 executes processing at step 606 shown in FIG. 10 to assign a read out key code to a hollow channel of the musical tone signal forming circuit 50, to memorize the key code and a discrimination data indicative of the assigned channel for automatic performance in the assignment channel list and to set a key on-off data in the list as a key-on data. Thereafter, the CPU 60 causes the musical tone signal forming circuit 50 to produce a musical tone signal of a tone pitch defined by the key code at the assigned channel and sets the read out gate time as a gate time count value GT(CH) designated by the channel number CH indicative of the assignment channel. Subsequently, the CPU 60 sets the reading pointer to a memory address value of the following performance data. When each performance data of tracks "3"–"8" is read out in such a manner as described above, the CPU 60 determines a "Yes" answer at step 522 and finishes the execution of the reproduction routine at step 524.

After execution of the reproduction routine, the CPU 60 executes at step 308 the comparative progression routine shown in FIG. 8 but does not execute substantive processing of the routine since the mode data MOD is still set as "0". Subsequently, the CPU 60 executes processing at step 310–322 shown in FIG. 7. In this instance, the channel number CH is successively increased from "0" to "15" by processing at step 310, 320 and 322. At step 312, the CPU 60 refers to the assignment channel list to determine whether the key on-off data designated by the channel number CH represents a key-on data or not and to determine whether the discrimination data designated by the channel number CH is the assigned channel for the automatic performance data or not. If the answer at step 312 is "No", the program proceeds to step 320. If the answer at step 312 is "Yes", the program proceeds to step 314 where the CPU 60 determines whether the gate time count value GT(CH) designated by the channel number CH is less than or equal to "0" or not. If the answer at step 314 is "No", the program proceeds to step 318 where the CPU 60 subtracts "1" from the gate time count value GT(CH) designated by the channel number CH. After processing at step 310–322, the CPU 60 finishes the execution of the interruption program at step 324.

At each time when the interruption program is executed. the CPU 60 subtracts "1" from the duration time count values TM(0)–TM(8) by processing of the reproduction routine at step 306 of FIG. 7 and subtracts "1" from the gate time count value GT(CH) by processing at step 310–322. When the gate time count value GT(CH) becomes "0", the CPU 60 determines a "Yes" answer at step 314 and causes the program to proceed to step 316 for mute processing.

During execution of mute processing at step 31.6, the CPU 60 changes the key on-off data designated by the channel number CH to a key-off data and applies the channel data and the key-off data to the musical tone signal forming circuit 50. Thus, the musical tone signal forming circuit 50 attenuates a musical tone signal being produced at the channel designated by the channel data and halts production of the musical tone signal.

When the duration time count value TM(TR) designated by the track number TR becomes "0", the following key code data and duration data are read out by processing at step 504 and 506, and the key code data is assigned to an available channel of the musical tone signal forming circuit 50 by processing at step 606 shown in FIG. 10. The key code and the discrimination data are memorized in the assignment channel list, and the key on-off data in the channel list is set as a key-on code. Thus, the musical tone signal forming circuit 50 produces a musical tone signal of a tone pitch defined by the key code at the assigned channel. Thereafter, the CPU 60 executes processing at step 608 and 610 to set the read out gate time as the gate time count value GT(CH) designated by the channel number CH indicative of the assigned channel.

With the foregoing operation of the CPU 60, each performance information of tracks "0" to "8" memorized in the automatic performance information memory 30 is automatically reproduced in sequence so that the musical tone signal forming circuit 50 produces a musical tone signal based on the reproduced performance information. When a phrase code shown in FIG. 2(A) is read out by processing at step 506 of FIG. 9 while the performance information is being read out, the CPU 60 determines a "Yes" answer at step 628 of the data processing routine and determines a "No" answer at step 630. At the following step 632, the CPU 60 sets the reading pointer to a memory address value of the following performance data. Thus, the CPU 60 skips over the phrase code to successively read out other performance data. When an end code is read out by processing at step 506, the CPU 60 determines a "Yes" answer at step 510 and causes the program to proceed to step 520 for reading out the performance data of the following track. Since in this instance the reading pointer does not proceed to a memory position of the following performance data, the CPU 60 finishes reproduction of the performance information when read out once the end code. Thus, each performance information of tracks "0" to "8" is automatically reproduced.

(C2) Right hand guide mode

Assuming that the mode data MOD has been set as "1" at the right hand guide mode of the electronic musical instrument, each performance information of tracks "0" to "8" is automatically reproduced in the same manner as in the normal reproduction mode. Since in this instance, the first performance data of the performance information of track "0" is a blink data as shown in FIG. 2(A), the CPU 60 reads out the blink data at step 508 of the reproduction routine shown in FIG. 9 and executes the data processing routine at step 514 after determined a "No" answer respectively at step 510 and 512. During execution of the data processing routine shown in FIG. 10, the CPU 60 determines a "Yes" answer at step 618 and causes the program to proceed to step 620 and 624. At step 620, the CPU 60 determines whether the read out performance data is a light data or not. At step 624, the CPU 60 determines whether the read out performance data is a blink data or not. Since in this instance, the read out performance data is a blink data, the CPU 60 determines a "Ycs" answer at step 624 and causes the program to proceed to step 626.

At step 626, the CPU 60 applies a control data indicative of the key code in the blink data and blinking to a light emitting element control circuit 13. In turn, the light-emitting element circuit 13 turns on and off a light-emitting element corresponding with a key instructed by the key code to inform the player of the key to be performed. After processing at step 626, the CPU 60 sets the reading pointer to a memory address value of the following performance data at step 632 and finishes the execution of the data processing routine at step 642. Thereafter, the CPU 60 reads out a duration data by processing at step 506 and reads out a light data by processing at step 506 after lapse of a time defined by the duration time in the duration data.

During execution of the data processing routine at step 514, the CPU 60 determines a "Yes" answer respectively at step 618 and 620 and causes the program to proceed to step 622. At step 622, the CPU 60 applies a control data indicative of the key code in the light data and lighting to the light-emitting element control circuit 13. In turn, the light-emitting element control circuit 13 turns on the light-emitting element corresponding with a key instructed by the key code to inform the player of the key to be presently performed. After processing at step 622, the CPU 60 reads out the key data by processing at step 632 and 506 in the same manner as described above.

During further execution of the data processing routine shown in FIG. 10. the CPU 60 determines a "Yes" answer respectively at step 602 and 604 and causes the program to proceed to step 614. At step 614, the CPU 60 writes the key code in the read out key data into an instruction key code list stored in the working memory 61. Subsequently, the CPU 60 sets the waiting flag WFLC as "1" at the following step 616 and causes the program to proceed to step 632 shown in FIG. 11. Thus, the CPU 60 reads out a blink data by processing at step 632 of FIG. 11 and 506 of FIG. 9. In this instance, the CPU 60 determines a "Yes" answer respectively at step 618 and 624 of FIG. 10 and executes processing at step 626 to turn on and off a light-emitting element 11 corresponding with a key represented by the key code in the blink data. Since the key code in the light data represents a tone pitch of the following note, the light-emitting element corresponding with a key to be subsequently depressed is turned on and off while the light-emitting element 11 corresponding with a key to be presently depressed is being lighted. After processing at step 626, the CPU 60 reads out the duration data by processing at step 632 of FIG. 11 and 506 of FIG. 9 and changes the track number TR to "1".

When finished execution of the reproduction routine of FIG. 9 after read out the performance information of track "8", the CPU 60 starts at step 308 of FIG. 7 to execute the comparative progression routine shown in FIG. 8. During execution of the comparative progression routine, the CPU 60 determines a "Yes" answer at step 402 and determines at step 404 whether the waiting flag WFLG is being set as "1"

or not. Since the waiting flag WFLG is set as "1" by processing at step 616 of FIG. 10, the CPU 60 determines a "Yes" answer at step 404 and causes the program to proceed to step 406. At step 406, the CPU 60 determines whether all the keys instructed by one or plural key codes in the instruction key code list are being depressed or not. The determination is made by comparison of the key code in the instruction key code list with the key code in the key performance data indicative of the key-on condition in the assignment channel list. When all the key codes in the instruction key code list coincide with the key code in the assignment channel list, it is determined by the CPU 60 that all the instructed keys are being depressed.

If all the keys instructed by the key codes in the instruction key code list are being depressed, the CPU 60 determines a "Yes" answer at step 406 and applies at step 408 all the key codes in the instruction key code list and a control data for turning off the light-emitting elements 11 to the light-emitting element control circuit 13. When applied with the key codes and control data, the light-emitting element control circuit 13 puts out lights of the light-emitting elements corresponding with all the key codes. After processing at step 408, the CPU 60 changes the waiting flag WFLG to "0" at step 410 and clears the memorized key codes in the instruction key code list at step 412. Thus, the CPU 60 finishes the execution of the comparative progression routine. In a condition where the waiting flag WFLG has been changed to "0", the CPU 60 executes the interruption program at the predetermined time interval to instruct key depression by blinking and lighting of the light-emitting elements 11 based on the performance information of the track "0".

If all the keys instructed by the key codes in the instruction key code list are not being depressed, the CPU 60 determines a "No" answer at step 406 and finishes the execution of the comparative progression routine at step 414. In this instance, the key codes in the key code list are maintained as it is, the light-emitting elements 11 corresponding with the key codes are maintained respectively in a lighted condition, and the waiting flag WFLG is maintained as "1". Accordingly, even when the interruption program of FIG. 7 is executed again, the CPU 60 determines a "Yes" answer at step 304 based on the waiting flag WFLG and finishes the execution of the interruption program at step 324. As a result, the readout of the performance information of all the tracks "0" to "8" is temporarily interrupted.

If either one of keys on the keyboard 10 is depressed in such a condition as described above, the CPU 60 executes sound processing at step 108 and the comparative progression routine at step 110 after determined a "Yes" answer respectively at step 104 and 106 of FIG. 4. During execution of the sound processing at step 108, channel assignment of the depressed key, renewal of the assignment channel list and production of a musical tone signal are controlled by the CPU 60. During execution of the comparative progression routine at step 110, the CPU 60 executes processing at step 406–412 since the waiting flag WFLG is maintained as "1". If in this instance, all the keys instructed by lighting are depressed, the CPU 60 determines a "Yes" answer at step 406, turns off all the light-emitting elements lighted by processing at step 408–412, changes the waiting flag WFLG to "0" and clears the memorized key codes in the instruction key code list. Thus, the temporarily interrupted reproduction of the automatic performance is restarted.

From the above description, it will be understood that at the right hand guide mode, each performance information of the tracks "1"–"8" is automatically reproduced during which the performance information of the track "0" is adapted to turn on the light-emitting elements 11 for instructing a key to be presently depressed by the player's right hand and to turn on and off the light-emitting elements 11 prior in one note for instructing a key to be subsequently depressed by the player's right hand. With such instruction of the keys to be depressed, the player can practice his right hand performance while listening to a musical tone of automatically reproduced other performance parts. If during the performance practice, a key instructed on a basis of the performance information of the track "0" is not correctly depressed, the progression of the automatic performance is temporarily interrupted to be restarted when the instructed key is correctly depressed. This is useful to enhance the performance practice effect.

(C3) Left hand guide mode

Assuming that the mode data MOD has been set as "2" at the left hand guide mode of the electronic musical instrument, each performance information of the tracks "0", "2"–"8" is reproduced in the same manner as in the normal reproduction mode. At this left hand guide mode, the performance information of track "1" is processed at step 614, 616, 620–626 on a basis of processing of the data processing routine at step 604, 618 shown in FIG. 10.

Accordingly, at the left hand guide mode, each performance information of tracks "0", "2"–"8" is automatically reproduced during which the performance information of track "1" is adapted to turn on and off the light-emitting element 11 prior in one note for instructing a key to be subsequently depressed by the player's left hand and to turn on the light-omitting element 11 for instructing a key to be presently depressed. With such instruction of the keys to be depressed, the player can practice his left hand performance while listening to a musical tone of automatically reproduced other performance parts. If during the performance practice, a key instructed on a basis of the performance information of track "1" is not correctly depressed, the progression of the automatic performance is temporarily interrupted to be restarted when the instructed key is correctly depressed. This is useful to enhance the performance practice effect at the player's left hand.

(C4) Both hand guide mode

Assuming that the mode data MOD has been set as "3" at the both hand guide mode of the electronic musical instrument, each performance information of tracks "2"–"8" is automatically reproduced in the same manner as in the normal reproduction mode. At this both hand guide mode, each performance information of tracks "0" and "1" is processed at step 614, 616, 620–626 on a basis of processing at step 604 and 618 of the data processing routine shown in FIG. 10.

Accordingly, at the both hand guide mode, each performance information of tracks "2"–"8" is automatically reproduced during which each performance information of tracks "0" and "1" is adapted to turn on and off the light-emitting element 11 prior in one note for instructing a key to be subsequently depressed by the player's right or left hand and to turn an the light-emitting element 11 for instructing a key to be presently depressed by the player's right or left hand. With such instruction of the keys to be depressed, the player can practice his both hands' performance while listening to a musical tone of automatically reproduced other performance parts. If during the performance practice, a key instructed on a basis of each performance information of tracks "0" and "1" is not correctly depressed, the progression of the automatic performance is temporarily interrupted to be restarted when the instructed key is correctly depressed. This is useful to enhance the performance practice effect at tie player's both hands.

(D) Repeat practice

Figure 5:
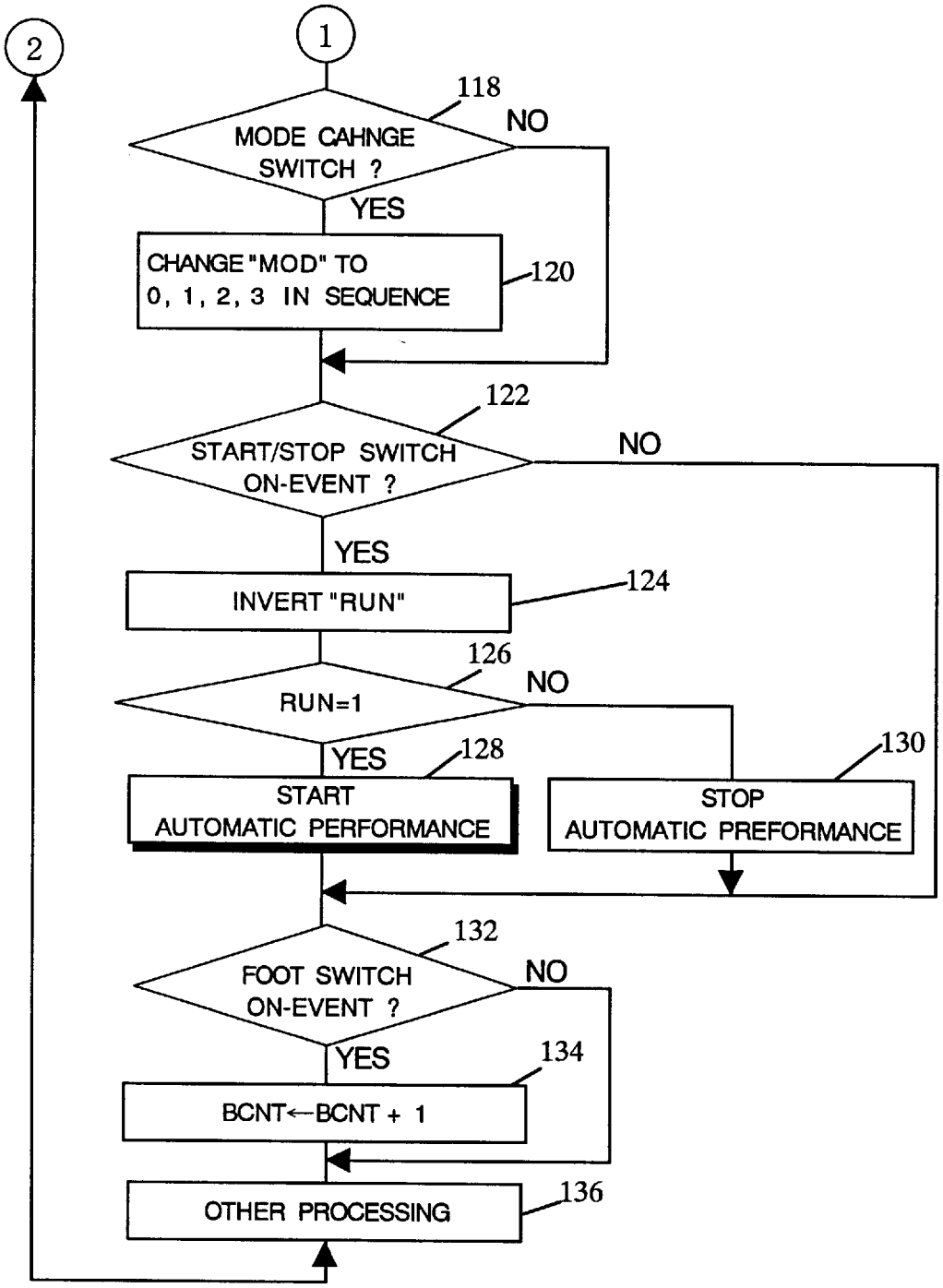
FIG. 5 illustrates a second part of the flow chart of the main program.

Assuming that the foot operation element 20 has been operated by the player's foot to turn on the foot switch 21 while each performance information of the tracks is being automatically reproduced during performance of the key board 10, the CPU 60 determines a "Yes" answer at step 132 shown in FIG. 5 and causes the program to proceed to step 134 where the CPU 60 adds "1" to the count value BCNT for designation of a return portion which is previously set as "0" at step 208 of the automatic performance start routine shown in FIG. 6 prior to start of the automatic performance. Accordingly, the count value BCNT becomes "1" when the foot operation element 20 is once operated and becomes "2" when the foot operation element 20 is twice operated. That is to say, the count value BCNT is determined in accordance with the number of operation of the foot operation element 20.

Figure 11:
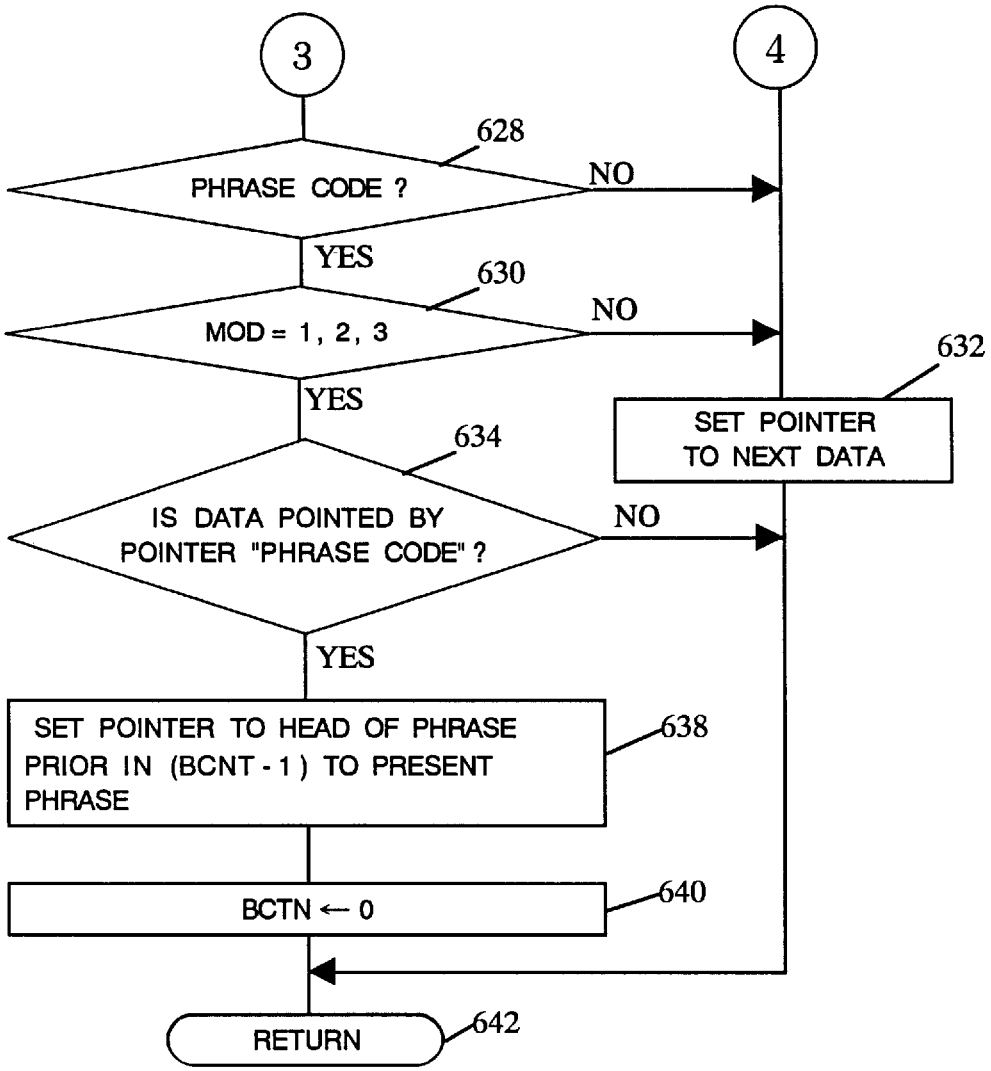
FIG. 11 illustrates a second part of the data processing routine.

Assuming that a phrase code has been represented by a performance data of all the tracks "0"–"8" read out by processing at step 506 of the reproduction routine while the interruption program is being executed in a condition where the mode data MOD was set as "1", "2" or "3", the CPU 60 determines a "Yes" answer at step 634 of the data processing routine shown in FIG. 11 and causes the program to proceed to step 638. Until the phrase code is represented by the performance data of all the tracks "0"–"8", the CPU 80 determines a "No" answer at step 634 and finishes the execution of the data processing routine at step 642. Since each phrase code of the tracks "0"–"8" is memorized in the same time position of each performance information, the CPU 60 determines a "Yes" answer at step 634 at the time when a phrase code was represented by the performance data of track "8" and causes the program to proceed to step 638.

At step 638, the CPU 60 sets each reading pointer of all the tracks "0"–"8" to a head address value of a phrase prior in (BCNT −1) to the present phrase. In this instance, "−1" means that each reading pointer of all the tracks "0"–"8" is set to a head address value of the following phrase, and "0" means that the reading pointer is set to a head address value of the present phrase. At present, the reading pointer indicates a memory position of a phrase code or a final memory position of the present phrase. Accordingly, if the foot operation element 20 is not operated, the reading pointer is set to a head address value of the following phrase so that the automatic performance and the instruction for key depression are continually conducted. When the foot operation element 20 is once operated, the reading pointer is set to a head address value of the present phrase so that the automatic performance and the instruction for key depression are repeatedly conducted after returned to the head of the present phrase. When the foot operation element 20 is operated more than twice, the reading pointer is set to a head address value of a phrase prior in (BCNT −1) to the present phrase so that the automatic performance and the instruction for key depression are repeatedly conducted after returned to the head of the prior phrase.

After processing at step 638, the CPU 60 initializes the count value BCNT to "0". Thus, the count value BCNT is set for each phrase in accordance with the number of operation of the foot operation element 20. In such a manner as described above, the automatic performance and the instruction for key depression are repeated for the same part in accordance with the number of operation of the foot operation element 20. Accordingly, the player can repeatedly concentrate into practice of a difficult phrase.

(E) Modification

Although in the above embodiment, a readout position of the performance data has been returned in a phrase unit by operation of the foot operation element 20, the readout position of the performance data may be returned in a measure unit. In such a case, a measure code indicative of a pause of a measure is included in the performance information in stead of the phrase code in the above embodiment. Alternatively, the reading pointer may be set to an address value returned in a predetermined note length reversely from a timing for key depression. In the case that a readout address value is memorized at a predetermined time interval during automatic performance, a readout position of performance data may be returned in a unit of the time interval.

Although in the above embodiment the foot operation element 20 has been adapted to return the readout position of the performance data to a desired position, the foot operation element 20 may be replaced with a foot pedal operation element such as a damper pedal, a sostenuto pedal in an electronic piano. The foot operation element may be further replaced with a manually operated element.

What is claimed is:

1. An electrical musical instrument comprising:

a plurality of performance operation elements;

mode selection means for selecting one of a plurality of different practice modes including at least one guide mode;

memory means for memorizing performance data corresponding to a musical tune, said performance data comprising at least one sequence of data indicative of ones of the performance operation elements;

readout means for successively reading performance data from said memory means;

instruction means for highlighting a performance operation element to be operated by a player on a basis of performance data read by the readout means if one of said at least one guide modes is selected;

operation means operable by a player for designating a repeat condition; and control means for returning a readout position of the performance data in a predetermined section to a previous readout position in response to operation of said operation means;

wherein said performance operation elements are in the form of a plurality of manually operated elements, and said operation means comprises an operation element to be operated by the player's foot.

2. An electronic musical instrument comprising:

a plurality of performance operation elements;

mode selection means for selecting one of a plurality of different practice modes including at least one guide mode;

memory means for memorizing performance data corresponding to a musical tune, said performance data comprising at least one sequence of data indicative of ones of the performance operation elements;

readout means for successively reading performance data from said memory means;

instruction means for highlighting a performance operation element to be operated by a player on a basis of performance data read by the readout means if one of said at least one guide modes is selected;

operation means operable by a player for designating a repeat condition; and control means for returning a readout position of the performance data in a predetermined section to a previous readout position in response to operation of said operation means;

wherein the predetermined section is defined to correspond with a phrase of said musical tune.

3. An electronic musical instrument comprising:

a plurality of performance operation elements;

mode selection means for selecting one of a plurality of different practice modes including at least one guide mode;

memory means for memorizing performance data corresponding to a musical tune, said performance data comprising at least one sequence of data indicative of ones of the performance operation elements;

readout means for successively reading performance data from said memory means;

instruction means for highlighting a performance operation element to be operated by a player on a basis of performance data read by the readout means if one of said at least one guide modes is selected;

operation means operable by a player for designating a repeat condition; and control means for returning a readout position of the performance data in a predetermined section to a previous readout position in response to operation of said operation means;

wherein the predetermined section is defined to correspond with a measure of said musical tune.

4. An electronic musical instrument comprising:

a plurality of performance operation elements;

memory means for memorizing a series of performance data indicative of the performance operation elements;

readout means for successively reading out the memorized performance data from said memory means in accordance with lapse of a time;

instruction means for instructing a performance operation element to be operated by a player on a basis of the read out performance data;

operation means to be operated by the player for causing said instruction means to repeatedly designate the readout of the instructed performance data;

count means for counting the number of operations of said operation means; and control means for returning a readout position of the performance data in a predetermined section to a previously read out position in response to operation of said operation means, wherein the predetermined section is determined in accordance with the number of operations counted by said count means.

5. An electronic musical instrument as recited in claim 4, wherein said performance operation elements are in the form of a plurality of manually operated elements, and said operation means comprises an operation element to be operated by the player's foot.

6. An electronic musical instrument as recited in claim 4, wherein the predetermined section is defined to correspond with a phrase of a musical tune.

7. An electronic musical instrument as recited in claim 4, wherein the predetermined section is defined to correspond with a measure of a musical tune.

8. An electrical musical instrument comprising:

a plurality of performance operation elements;

mode selection means for selecting one of a plurality of different practice modes including at least one guide mode;

memory means for memorizing performance data corresponding to a musical tune, said performance data comprising at least one sequence of data indicative of ones of the performance operation elements;

readout means for successively reading performance data from said memory means;

instruction means for highlighting a performance operation element to be operated by a player on a basis of performance data read by the readout means if one of said at least one guide modes is selected;

operation means operable by a player for designating a repeat condition; and control means for returning a readout position of the performance data in a predetermined section to a previous readout position in response to operation of said operation means;

wherein said at least one guide mode comprises a right hand guide mode, a left hand guide mode, and a two hand guide mode.

* * * * *